US010056172B2

(12) United States Patent
Fichtner et al.

(10) Patent No.: US 10,056,172 B2
(45) Date of Patent: Aug. 21, 2018

(54) METHOD FOR PRODUCING A COAXIAL CABLE

(71) Applicants: Nikolaus Fichtner, St. Gallen (CH); Franz Manser, Herisau (CH)

(72) Inventors: Nikolaus Fichtner, St. Gallen (CH); Franz Manser, Herisau (CH)

(73) Assignee: Huber+Suhner AG, Herisau (CH)

( * ) Notice: Subject to any disclaimer, the term of this patent is extended or adjusted under 35 U.S.C. 154(b) by 702 days.

(21) Appl. No.: 14/382,453

(22) PCT Filed: Feb. 26, 2013

(86) PCT No.: PCT/EP2013/053809
§ 371 (c)(1),
(2) Date: Sep. 2, 2014

(87) PCT Pub. No.: WO2013/131779
PCT Pub. Date: Sep. 12, 2013

(65) Prior Publication Data
US 2015/0096781 A1 Apr. 9, 2015

(30) Foreign Application Priority Data
Mar. 5, 2012 (CH) ..... 283/12

(51) Int. Cl.
*H01R 43/00* (2006.01)
*H01B 13/016* (2006.01)
(Continued)

(52) U.S. Cl.
CPC ..... *H01B 13/0162* (2013.01); *H01B 7/303* (2013.01); *H01B 11/1808* (2013.01);
(Continued)

(58) Field of Classification Search
CPC ..... H01B 13/0006; H01B 13/0162; D07B 7/027; Y10T 29/532; Y10T 29/49123; B21B 1/18
(Continued)

(56) References Cited

U.S. PATENT DOCUMENTS 3,538,697 A 11/1970 Hornor et al.
3,651,243 A 3/1972 Hornor et al.
(Continued)

FOREIGN PATENT DOCUMENTS

CN 1540683 A 10/2004
CN 102110498 A 6/2011
(Continued)

OTHER PUBLICATIONS

Japanese Patent Office (JPO), Office Action—Notice of Reasons for Rejection, dated Mar. 29, 2016, Japanese Patent Application P2014-560306 (4 pages).
(Continued)

*Primary Examiner* — Donghai D Nguyen
(74) *Attorney, Agent, or Firm* — Pauley Erickson & Kottis

(57) ABSTRACT

The invention relates to a method for producing a stranded inner conductor (1), and to a coaxial cable (9). In a first step, a stranded inner conductor (2) is provided, which consists of several wires (3) twisted together. Then the stranded inner conductor (1) is rotary swaged by means of a rotary swaging device (10). In a further step, the rotary swaged stranded inner conductor (3) is enclosed with a dielectric (4). In a further step, the dielectric (4) is enclosed with an outer conductor (5) and a cable sheath (6).

20 Claims, 3 Drawing Sheets

(51) Int. Cl.

| | |
|---|---|
| ***H01B 13/00*** | (2006.01) |
| ***H01B 7/30*** | (2006.01) |
| ***H01B 11/18*** | (2006.01) |
| *D07B 7/02* | (2006.01) |

(52) U.S. Cl.
CPC ..... *H01B 11/1895* (2013.01); *H01B 13/0006* (2013.01); *D07B 7/027* (2013.01); *Y10T 29/49123* (2015.01); *Y10T 29/532* (2015.01)

(58) Field of Classification Search
USPC ..... 29/828, 33 F, 745; 156/50, 56; 174/28, 174/128.1; 72/11.5
See application file for complete search history.

(56) References Cited

U.S. PATENT DOCUMENTS

| | | | | |
|---|---|---|---|---|
| 4,229,238 | A * | 10/1980 | Saito | H01B 11/1847 156/50 |
| 5,673,584 | A * | 10/1997 | Kuroda | B21B 1/18 72/11.5 |
| 6,023,026 | A | 2/2000 | Funahashi et al. | |
| 6,307,156 | B1 * | 10/2001 | Avellanet | B21C 37/045 174/28 |
| 6,641,444 | B2 | 11/2003 | Hanazaki et al. | |
| 7,174,633 | B2 | 2/2007 | Onuma | |

FOREIGN PATENT DOCUMENTS

| | | | |
|---|---|---|---|
| CN | 201898001 | U | 7/2011 |
| DE | 1 943 229 | A1 | 10/1970 |
| DE | 198 35 901 | A1 | 2/1999 |
| GB | 794411 | A | 5/1958 |
| JP | 59-163017 | A | 9/1984 |
| JP | 06-119825 | A | 4/1994 |
| JP | 7-226118 | | 8/1995 |
| JP | 07-226118 | A | 8/1995 |
| JP | 07-240120 | A | 9/1995 |
| JP | 7 249329 | A | 9/1995 |
| JP | 3257388 | B2 | 2/2002 |
| JP | 2004-207386 | A | 7/2004 |
| JP | 2004-327345 | A | 11/2004 |
| WO | WO 99/49475 | A1 | 9/1999 |

OTHER PUBLICATIONS

Chinese Patent Office, Second Notification of Office Action and Search Report, dated Jul. 8, 2016, Chinese Patent Applicaiton No. 201380012428.1 (11 pages).

* cited by examiner

METHOD FOR PRODUCING A COAXIAL CABLE

BACKGROUND OF THE INVENTION

Field of the Invention

The invention relates to the field of inner conductors for a coaxial cable or to the field of coaxial cables for transmitting high-frequency signals.

Coaxial cables for transmitting signals with high frequencies are known from the prior art. These cables comprise an inner conductor which is surrounded by a dielectric and an outer conductor.

Rotary swaging machines, by means of which ductile materials can be deformed either continuously or intermittently, have been known from the prior art since the beginning of the last century. These rotary swaging machines generally comprise a forming tool consisting of two or four jaws arranged in pairs opposite one another. The jaws of the forming tool are for example deflected inwards in the radial direction by means of circumferential rollers. At the same time, said jaws move in the circumferential direction. The forming tool comprises a central, mostly continuous, working opening which has a tapering cross section in the longitudinal direction. Work pieces to be processed can be introduced into the working opening of the forming tool and removed via the same opening or, in the case of a continuous process, via a second opposite opening. The work piece is continuously deformed within the working opening by means of the jaws which move in the radial and circumferential direction. As a result of the movement of the jaws, the working opening has a variable cross section. Rotary swaging is used for example in the production of wire ropes or forged pieces in the motor industry. A number of fields of application for rotary swaging machines are known from the patent literature. A few selected examples will be briefly described below.

Discussion of Related Art

U.S. Pat. No. 6,641,444B2 from the Yazaki Corporation, granted on Nov. 4, 2003, describes a structure and a method for joining an electric cable and a cable end piece by means of rotary swaging. For this purpose, the insulation is first stripped at the cable end, so that the litz conductor is exposed. Said litz conductor is then slid into a hollow cylindrical sleeve. Next, the sleeve is compressed in the radial direction by means of rotary swaging. This compression compacts the litz conductor and thus reduces the electrical resistance.

U.S. Pat. No. 7,174,633B2 from the Yazaki Corporation, granted on Feb. 13, 2007, also describes a method for connecting an electric cable to a cable end piece. To do this, an electrically conductive adhesive (e.g. a paste made of epoxy and nickel powder) is filled into a tubular end of a cable end piece. Next, the litz conductor of the cable end, having been stripped beforehand, is inserted into the hole. The tubular cable end piece is then radially compressed by means of rotary swaging and brought into tight contact with the litz conductor. The nickel powder in the paste, as the conductive filler, should thereby destroy any possible oxide layers on the metal parts and increase the conductivity.

The Japanese publication JP7226118A2 from the Yazaki Corporation describes the use of a rotary swaging method to prevent uncontrolled deformation of a wire rope in a subsequent rolling process. The use of a wire rope which is stranded in multiple layers is provided. The rolling process serves for the reduction of the diameter and for the increase of the length of the wire rope, respectively.

The Japanese publication JP7249329A2 from the Yazaki Corporation describes the production of a compressed concentric multi-layer wire rope and an apparatus for the production thereof. In the described method, the rope is first stranded from a plurality of wires. Before being wound up, the cable is compressed radially and deformed by a rotary swaging tool.

The Japanese patent JP3257388B2 from the Yazaki Corporation describes the geometry of a plurality of different forming tools for compressing multi-layer stranded wire strands by means of rotary swaging. Since relative rotations between the wire rope and the rotary swaging tool may cause damage to the wire rope at least at high compression levels, the swaging jaws, when closed, do not form a circular cross section, but rather a cross section which is flattened at the jaw edges.

The German publication DE19835901A1 from River Seiko KK and Asahi Optical Co. Ltd. describes an endoscopic wire loop which is made of corrosion-resistant wire and can be used for example for the surgical removal of polyps using high-frequency electric current. According to DE'901, such loops are typically produced from stranded wires. A frequent feature of corresponding loops is a sharp U-shaped curvature at the distal end thereof, which is intended to improve the withdrawal of the loop back into the sleeve-shaped endoscopic guide instrument. In practice, however, the very small radius of curvature in the U-shaped part causes the wires of the strand to slacken and to be irregularly deformed, which leads to uncontrolled spreading of the wires. In the event of high mechanical stress or Joule heating, this can cause the tool to break down. The method used, as described in DE'901, is based on a forging process in which a stranded wire is guided through a forging die, the hole in which has a diameter which is (8-10.5%) smaller than that of the strand. This leads to radial compression of the strand. This causes the wires of the strand to be deformed and the gaps between the wires to disappear. The wires at the surface are thus given a trapezoidal cross section and the entire stranded wire is given a very smooth surface. The resultant stranded wire should maintain this smooth surface even in the case of a sharp curvature, and it is not fanned out into its wires, respectively. In addition, it is stated that the wire according to the invention "looks superior in quality" and that as a result a wire loop instrument produced therefrom has a high commercial value.

GB794411A from British Ropes Ltd. was published in 1958 and claims a method, and a means for the implementation thereof, for treating wire ropes such that its wires are given a cross section which deviates from the round shape owing to the influence of external radial forces. This method is characterised in by an axial bias of the rope, which bias is constantly active in the region of the radial pressure forces during deformation. Together with the radial force, this axial force leads to an increase in the length of the rope and the strands, respectively. The axial force is selected such that the wire material begins to yield. Radial forces can be exerted by means of a rotating tool.

U.S. Pat. No. 6,023,026 from the Nippon Cable Systems Inc. was published in 2000 and describes a new type of rotary swaged, forged steel rope, which has both high mechanical flexibility/suppleness and high tensile strength. These improved properties are the result of both an optimized composition of the individual rope lines as well as specified wire diameter ratios and a measure for the compression during the deformation process.

DE1943229 (or U.S. Pat. No. 3,651,243) from Western Electric Co. Inc. was first published in 1970 and relates to a coaxial cable comprising a stranded inner conductor. Undesired spikes in the return loss are reduced by varying the pitch during stranding.

SUMMARY OF THE INVENTION

It is an object of the invention to disclose a method for producing an improved litz inner conductor, or an improved coaxial cable, respectively, for the transmission of high-frequency signals.

This object is achieved by the method defined in the claims.

Nowadays, conventional coaxial cables comprise inner conductors made of one wire or litz inner conductors made of a plurality of wires. The inner conductors consisting of a plurality of wires are generally stranded prior to being installed in the cable. During development of premium cables for the high-frequency range, it has been found that both the inner architecture and the surface texture of the inserted litz conductor can have a significant effect on the mechanical and electrical properties thereof. Compared to solid wire conductors, litz inner conductors have an increased mechanical flexibility and are less prone to breaking. However, there is the risk inter alia of litz inner conductors spreading out at curvatures that are below a critical bend radius, in other words that the tight arrangement of the wires becomes loose and said wires separate out. This can cause a deterioration in the transmission properties and thus to problems when using the cable. In coaxial cables comprising litz inner conductors, two disadvantages arise from the architecture of the inner conductor by comparison with cables comprising inner conductors made of one single solid wire. On the one hand, the return loss (RL) has minima at certain frequencies and on the other hand, an increased insertion loss (IL).

Commercially available litz inner conductors for coaxial cables have a frequency-dependent return loss (RL) which has a negative effect on the transmission properties and is caused by flaws present in the cable. The return loss denotes a logarithmic measure for the ratio of the signal energy fed in to the reflected signal energy at a fixed signal frequency. The return loss is generally given in the unit dB (decibel). Since the reflected signal energy is always smaller than the signal energy fed in, the return loss is always a positive value. Coaxial cables should basically be designed so as to maximise the return loss and thus transmit the maximum signal energy. Typical return loss values are in the range of from 20 dB to 30 dB, which corresponds to a reflected signal energy of 1% or 0.1% of the signal energy fed in. In coaxial cables comprising litz inner conductors, the return loss often exhibits minima at signal frequencies which are given by the structural design of the litz inner conductor. These minima will hereinafter be given the term RL spikes. From the aforesaid DE1943229 it is known that RL spikes can be reduced by varying the strand pitch along the strand. The strand pitch, or pitch for short, is the length a wire of the strand travels during one revolution along the strand. Depending on the design and production, the strand pitch can only be varied between and upper and a lower limit, in other words between a minimum and a maximum pitch. Generally, the variation in the strand pitch between these extremes is not sufficient to eliminate all of the RL spikes.

There are many approaches to reducing the IL value. One costly approach is the stranding of insulated (enamelled) wires. One approach is coating the strands for example with silver or another material (noble metal) which improves the conductivity.

The aforesaid problems can be reduced by the method according to the invention and the transmission properties of a coaxial cable produced in accordance with the method according to the invention can be improved. The method according to the invention can improve both the electrical properties of cables and the mechanical properties thereof at the same time.

A method according to the invention for producing a coaxial cable generally comprises the steps of:

a) producing a litz inner conductor by stranding a plurality of wires with a constant and/or variable pitch;

b) rotary swaging the litz inner conductor by means of a rotary swaging device;

c) encasing the litz inner conductor with a dielectric;

d) encasing the dielectric with an outer conductor;

e) encasing the outer conductor with an outer sheath.

The surface of the wires is coated as required prior to stranding and/or prior to rotary swaging. Good results can be obtained using coatings made of silver, gold or tin.

A stranded, rotary swaged litz inner conductor produced in accordance with the method according to the invention has, inter alia, the following advantages:

a) The litz inner conductor according to the invention comprises a homogenous outer surface which is comparable with the surface of an individual wire.

b) The litz inner conductor according to the invention comprises compressed and more homogenous inner surfaces which counteract adverse oxide formation.

c) Damage to the coating of the individual wires can be avoided during rotary swaging.

d) The litz inner conductor according to the invention has lower loss during signal transmission, since there is more effective conductor surface available.

e) The litz inner conductor according to the invention has reduced RL spikes. At the same time, the RL level is improved.

f) The litz inner conductor according to the invention is less susceptible to fanning out under mechanical stress (bending, torsion, shaking), in other words the wires remain in position and the rotary swaged litz inner conductor maintains its shape even in the case of very small bend radii.

g) Following rotary swaging, the litz inner conductor according to the invention has a cross section which remains constant along its length. This reduces the periodicity in the conductor structure. This leads to a reduction in the RL spikes.

One embodiment of a method according to the invention for producing a litz inner conductor for a coaxial cable, or for producing a coaxial cable, comprises the steps of: providing a litz inner conductor consisting of a plurality of stranded wires; rotary swaging the litz inner conductor by means of a rotary swaging device in order to make the cross sections of the wires equal to one another; encasing the litz inner conductor with a dielectric; encasing the dielectric with an outer conductor. The wires are advantageously rotary swaged until they abut one another without any gaps. A constant or variable pitch can be used during stranding. According to the field of application, the outer conductor is constructed either as one layer or in multiple layers. For example, said outer conductor can be formed as a braid (braided outer conductor) and/or as a foil outer conductor and/or a tube outer conductor and/or a tape outer conductor. The dielectric can be constructed either as one layer or in multiple layers and can be by means of a device connected downstream of the rotary swaging device for applying the dielectric. In addition, a device for applying an outer conductor to the dielectric can be connected downstream thereof. The surface of the wires can be coated as required prior to the rotary swaging. For example, the surface of the wires can be silver-plated. If necessary, the outer conductor can be rotary swaged in a plurality of steps by means of a plurality of rotary swaging devices connected one behind the other. In the case of a litz inner conductor that is stranded in multiple layers, for example, it is possible to rotary swage the individual layers in succession. Some or many of the wires of the litz inner conductor can be subjected to an additional method step between the rotary swaging processes.

A device for producing a litz inner conductor according to the invention, or for producing a coaxial cable, generally comprises one or more rotary swaging devices arranged one after the other from the process flow. The device also comprises a feed means for feeding one or more stranded litz inner conductors to the rotary swaging device. The device further comprises a removal means which is used to guide the rotary swaged litz inner conductor away. The feed means can be one or more (in particular in the case of a plurality of pitches) stranding machines connected one behind the other. The feed means can also be a supply roller, on which the litz inner conductor or individual pitches thereof are wound. The removal means can be a machine for applying a dielectric to the rotary swaged litz inner conductor.

BRIEF DESCRIPTION OF THE DRAWINGS

Additional aspects of the invention will now be described in greater detail with reference to the embodiment described in the following figures, in which:

FIG. 6(*b*) shows the contours of the micrograph according to (a);

FIG. 7(*b*) shows the contours of the micrograph according to (a); and

FIG. 1 is a schematic and highly simplified view of a conventional coaxial cable 100, as known from the prior art, comprising a stranded litz inner conductor. When viewed in the longitudinal direction (x-direction), said cable comprises flaws 101 (shown schematically as semicircles) in the outer conductor which are arranged periodically and have a negative effect on the transmission behaviour and system behaviour of the coaxial cable, depending on the frequency. The flaws 101 are arranged with a spacing of $\lambda/2$ or a multiple thereof (nth factor). The flaws 101 cause a part 102 of the input signal 103 fed in to be reflected at each flaw 101. Owing to the periodicity of the flaws 101, the signal parts that are scattered back are in the same phase position at the input of the coaxial cable and thus interfere constructively. This leads to an increase of the reflected signal part at a single frequency or in a narrow frequency band.

FIG. 2 is a first graph schematically showing the frequency-dependent return loss behaviour of a conventional coaxial cable comprising a litz inner conductor according to FIG. 1. The x-axis shows the frequency (f) and the y-axis shows the return loss in dB. The permissible thresholds for the return loss are shown in the form of a horizontal line 105. The progression of the return flow can be seen in the form of a first curve 106 which fluctuates strongly. It can be seen that at two narrow-band points 107 and 108 the return loss has distinct minima and the permissible thresholds 105 are exceeded. The minima are given the term RL spikes.

FIG. 3 is a second graph showing, in the form of a second curve 109, the return loss (y-axis) of a coaxial cable according to the invention comprising a litz inner conductor according to FIG. 4 as a function of the frequency (x-axis). The permissible thresholds for the return loss are again represented by a horizontal line 110. As can be seen, the cable according to the invention does not have the RL spikes that exceed the thresholds, as is the case with the cable known from the prior art according to the graph in FIG. 2.

FIG. 4 is a perspective, diagonal front view from above of a stranded litz inner conductor in a non-processed state 1 and of the same litz inner conductor in a processed state 2. FIG. 5 is a side view of the arrangement according to FIG. 1. FIG. 6 is a sectional view through the litz inner conductor 1 along the section line EE according to FIG. 4. FIG. 7 is a sectional view through the litz inner conductor 2 along the section line FF according to FIG. 4. FIG. 8 is a schematic sectional view of a structure of a coaxial cable 9 comprising a litz inner conductor 2 according to the invention.

DETAILED DESCRIPTION OF THE INVENTION

In the method according to the invention, the litz inner conductor I is deformed into the processed litz inner conductor 2 by means of a rotary swaging device 10.

FIG. 6*a* is a photograph of a cross section (micrograph) of a conventional stranded litz inner conductor 1. FIG. 6*b* is a graphical view of the same cross section. FIG. 7*a* is a photograph of a cross section (micrograph) of a rotary swaged litz inner conductor 2 according to the invention. FIG. 7*b* is a graphical view of the same cross section.

Figure 1:
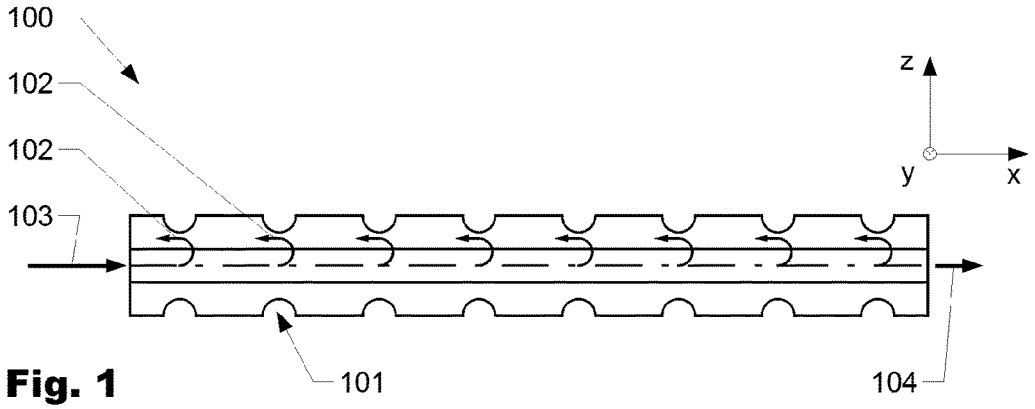
FIG. 1 shows a coaxial cable having periodic faults, which are shown symbolically by constrictions in the outer conductor.
Figure 2:
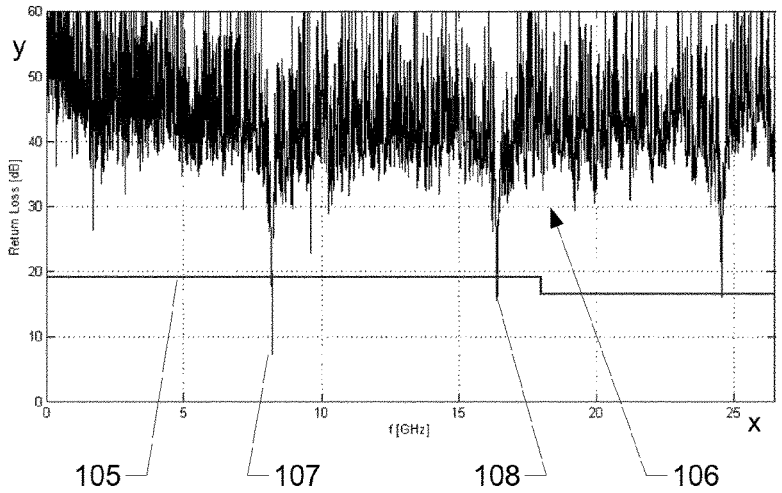
FIG. 2 is a first graph showing the frequency-dependent return loss progression of a coaxial cable according to FIG. 1.
Figure 3:
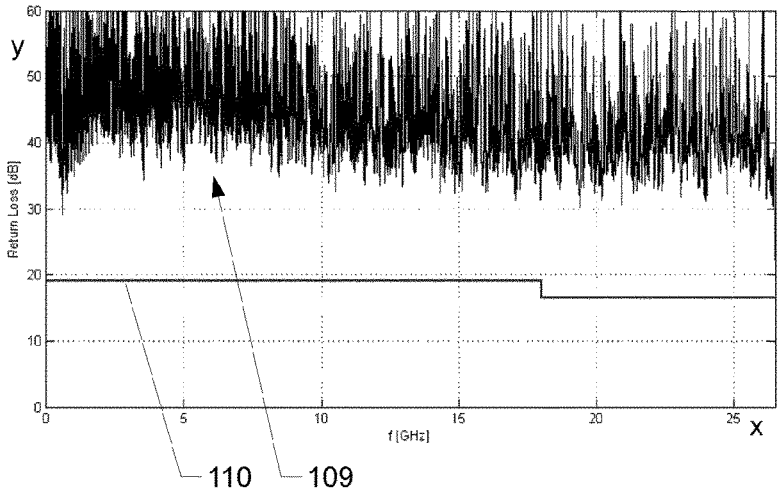
FIG. 3 is a second graph showing the frequency-dependent return loss progression of a coaxial cable according to the invention.
Figure 4:
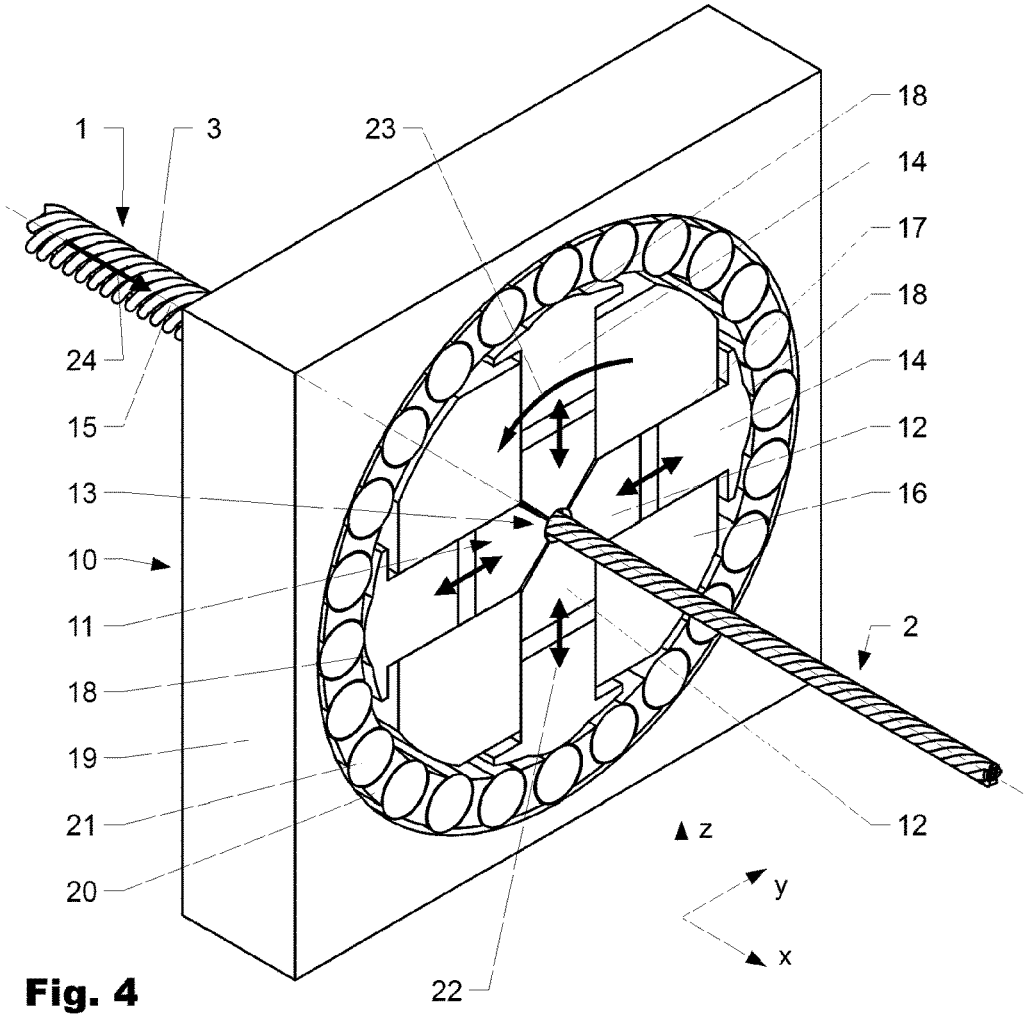
FIG. 4 is a schematic view of the production of an inner conductor according to the invention for a coaxial cable according to the invention.
Figure 5:
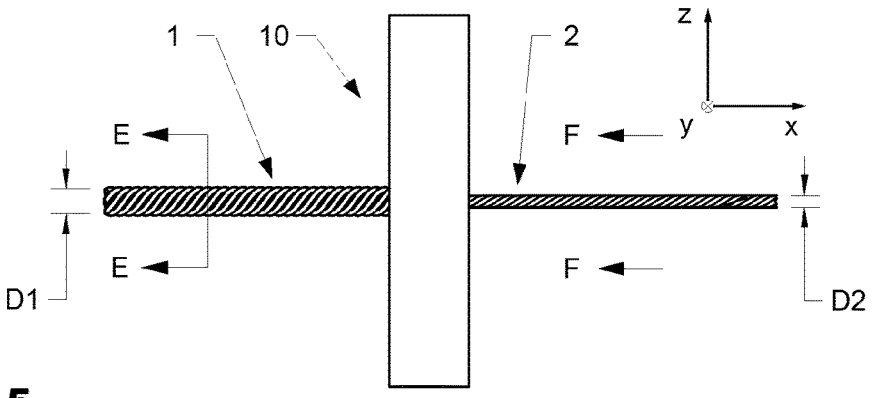
FIG. 5 is a side view of the arrangement shown in FIG. 4.
Figure 6:
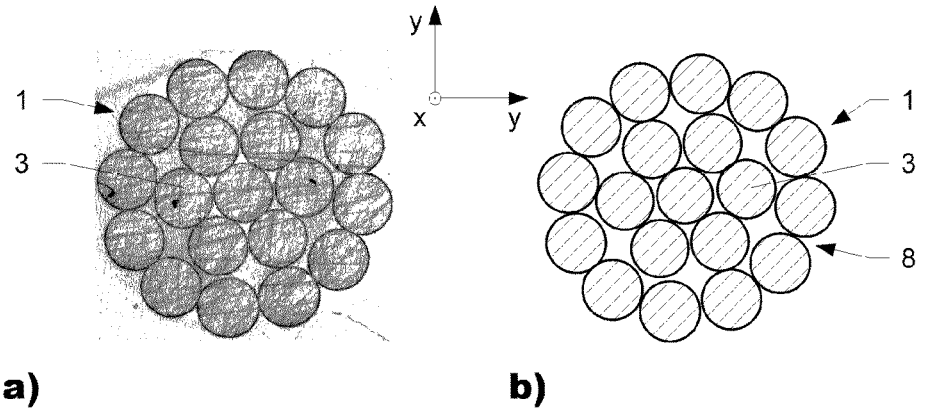
FIG. 6(*a*) is a micrograph of a stranded litz inner conductor.
Figure 7:
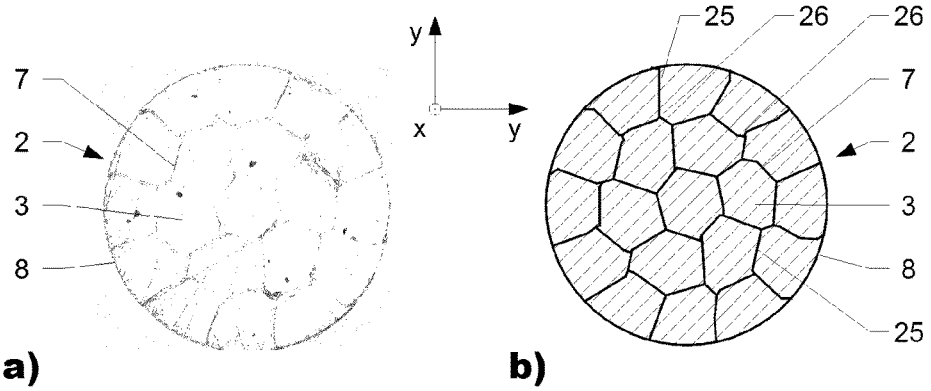
FIG. 7(*a*) is a micrograph of a litz inner conductor according to the invention.

When comparing the sectional images of FIGS. 6 and 7, it is apparent that prior to the rotary swaging (cf. FIG. 6*a* or 6*b*) wires 3 are arranged comparatively loosely and at a large spacing with respect to one another and do not necessarily abut one another. In addition, the litz inner conductor 1 comprises an irregular and bumpy outer face 8.

By contrast, the wires 3 in the rotary swaged litz inner conductor 2 according to FIG. 7*a* or 7*b* are arranged so as to closely abut one another and without any spaces in between. When viewed in cross section, they have a polygonal structure with generally four to six straight or slightly curved side walls 25, which merge into one another via kinks 26.

In the embodiment shown, the rotary swaging device 10 comprises a tool 11 which in the embodiment shown has four jaws 12. The jaws 12 form a processing opening 13 which is continuous in the centre. The jaws 12 are driven by outer rams 14 so as to be deflected in the radial direction of an axis of rotation 15 (cf. arrow 22), meanwhile a working shaft 16, in which the jaws 12 and the outer rams 14 are arranged mounted in recesses 17, rotates about the axis of rotation 15 (cf. arrow 23). The outer rams 14 comprise ramp-like enlargements 18 which interact with rollers 21 that are arranged in an outer ring 19 and mounted in a cage 20. The outer ring 19 supports the rollers in the radial direction. By means of the rotation of the working shaft 16, the ramps 18 are moved over the rollers 21, which rotate therewith, and are thus deflected inwards. This movement is transferred to the jaws 12 of the tool 11. Other drive mechanisms are possible. The stranded litz conductor 1 is moved through the processing opening 13 of the tool 11 in the direction of the arrow 24. The wires 3 are thereby compressed and the cross section thereof is deformed as shown in the subsequent figures. The cross section of the stranded litz inner conductor is reduced thereby from a first diameter D1 to a second diameter D2. Depending on the field of application, the diameters D2 to D1 are typically at a ratio of 0.5-0.9 to one another. Below approximately 0.77, all the intermediate regions between the wires 3 are filled and the wires can be stretched in the longitudinal direction, which this leads to an increase of the length of the inner conductor 2.

As is particularly recognizable from FIG. 7, following the rotary swaging the wires 3 closely abut one another and exhibit a cross section which is practically gap-free. In particular, the cross sections of the wires 3 are no longer round but are rather shaped polygonal. In the embodiment shown, the litz conductor comprises a circular outer face 8, which is highly constant over the length of the litz conductor. In some regions, the inner faces 7 abut one another in a toothed manner. They are formed such that the wires 3 can nevertheless be displaced relative to one another in the longitudinal direction.

Figure 8:
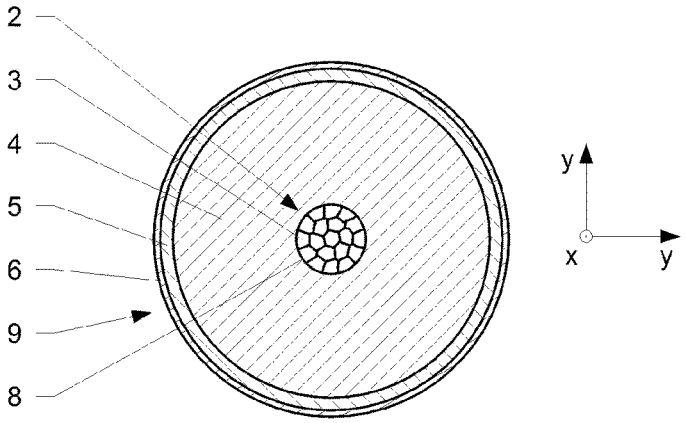
FIG. 8 is a schematic view of the structure of a coaxial cable according to the invention.

The coaxial cable 9 according to the invention and as shown in FIG. 8, comprises a stranded and rotary swaged litz inner conductor 2, which is surrounded by a dielectric 4. The dielectric 4 is in turn surrounded by an outer conductor 5 arranged concentrically with the outer face 8. Here, the outer conductor 5 is enclosed by a protective outer sheath 6. Other outer conductors 5 are possible, e.g. the litz inner conductor 2 and the dielectric 4 can also be surrounded by a rigid outer conductor or housing (not shown in greater detail), respectively. Good results are obtained using litz inner conductors having a diameter of from 0.1 to 3 mm. Said inner conductors (depending on the field of application) generally comprise 7, 19 or 37 individual wires. In this case, the diameter of the individual wires is in the range of from 0.02 to 0.6 mm prior to the rotary swaging. The litz inner conductors according to the invention are well suited for very high transmission frequencies of up to 110 GHz.

The invention claimed is:

1. A method for producing a high-frequency coaxial cable (9) comprising the steps of:

a) providing a litz inner conductor (1) comprising a plurality of wires (3) that have been stranded together along a longitudinal axis;

b) rotary swaging the litz inner conductor (1) directly by means of a rotary swaging device (10) having an axis of rotation that is parallel to the longitudinal axis, for lowering signal transmission loss and increasing signal return loss;

c) encasing the rotary swaged litz inner conductor (2) with a dielectric (4); and d) encasing the dielectric (4) with an outer conductor (5).

2. The method according to claim 1, wherein the stranded litz inner conductor (1) includes a constant and/or variable pitch.

3. The method according to claim 1, wherein the outer conductor (5) in encased with an outer sheath (6).

4. The method according to claim 1, wherein the outer conductor (5) is produced as a braided outer conductor and/or a tube outer conductor and/or a foil outer conductor and/or a tape outer conductor.

5. The method according to claim 1, wherein the dielectric (4) is designed in multiple layers.

6. The method according to claim 1, wherein a surface of the wires (3) is coated.

7. The method according to claim 6, wherein the surface of the wires (3) is coated with gold, silver or tin.

8. The method according to claim 1, wherein the inner conductor (1) is rotary swaged by means of a plurality of rotary swaging devices (10) connected one behind the other.

9. The method according to claim 8, wherein the litz inner conductor (2) is subjected to an additional method step between the rotary swaging processes.

10. The method according to claim 1, wherein the litz inner conductor is in direct contact with the rotary swaging device during the rotary swaging.

11. The method according to claim 1, wherein the rotary swaging reduces a diameter of the litz inner conductor.

12. The method according to claim 1, wherein the rotary swaging reduces spacing between the plurality of wires in the litz inner conductor.

13. The method according to claim 12, wherein the rotary swaging forms a polygonal cross sectional wire shape from a round cross sectional wire shape for each of the plurality of wires.

14. The method according to claim 12, further comprising rotary swaging a full length of the litz inner conductor.

15. The method according to claim 1, further comprising rotary swaging to obtain a homogeneous outer surface for the litz inner conductor homogeneous.

16. A method for producing a high-frequency coaxial cable (9) comprising the steps of:

a) providing a litz inner conductor (1) comprising a plurality of wires (3) stranded together along a longitudinal axis and with gaps therebetween;

b) rotary swaging the litz inner conductor (1) directly by means of a rotary swaging device (10) having an axis of rotation that is parallel to the longitudinal axis, to the wires abut each other without the gaps, for lowering signal transmission loss and increasing signal return loss;

c) encasing the rotary swaged litz inner conductor (2) with a dielectric (4); and d) encasing the dielectric (4) with an outer conductor (5).

17. The method according to claim 16, further comprising rotary swaging a full length of the litz inner conductor.

18. The method according to claim 16, wherein the rotary swaging smooths an irregular outer surface of the litz inner conductor into a homogenous outer surface.

19. A method for producing a high-frequency coaxial cable (9) comprising the steps of:

a) providing a litz inner conductor (1) comprising an outer surface and a plurality of wires (3) stranded together along a longitudinal axis and with gaps therebetween, wherein each of the wires comprises a round cross section;

b) rotary swaging the litz inner conductor (1) directly on the outer surface by means of a rotary swaging device (10) having an axis of rotation that is parallel to the longitudinal axis, to reduce a size of the gaps by pressing the round cross sections into polygonal cross sections, wherein the rotary swaging lowers signal transmission loss and increases signal return loss;

c) encasing the rotary swaged litz inner conductor (2) with a dielectric (4); and d) encasing the dielectric (4) with an outer conductor (5).

20. The method according to claim 19, further comprising rotary swaging a full length of the litz inner conductor, wherein the rotary swaging and the polygonal cross sections provide a homogeneous outer surface for the litz inner conductor.

* * * * *